US006675892B2

(12) United States Patent
Kuchuk et al.

(10) Patent No.: US 6,675,892 B2
(45) Date of Patent: Jan. 13, 2004

(54) WELL TESTING USING MULTIPLE PRESSURE MEASUREMENTS

(75) Inventors: Fikri J. Kuchuk, Dubai (AE); Terizhandur S. Ramakrishnan, Bethel, CT (US); Alpaslan Z. Tengirsek, Kuala Lampur (ML); Ashok K. Belani, San Jose, CA (US); Tarek M. Habashy, Danbury, CT (US); Adrian Douglas, Apache Junction, AZ (US)

(73) Assignee: Schlumberger Technology Corporation, Sugar Land, TX (US)

( * ) Notice: Subject to any disclaimer, the term of this patent is extended or adjusted under 35 U.S.C. 154(b) by 7 days.

(21) Appl. No.: 10/170,617

(22) Filed: Jun. 13, 2002

(65) Prior Publication Data

US 2003/0213591 A1 Nov. 20, 2003

Related U.S. Application Data

(60) Provisional application No. 60/381,856, filed on May 20, 2002.

(51) Int. Cl.[7] ..... E21B 47/06

(52) U.S. Cl. ..... 166/250.02; 166/252

(58) Field of Search ..... 166/250.01, 250.02, 166/252.1, 265, 306, 106, 387, 378

(56) References Cited

U.S. PATENT DOCUMENTS 4,803,483 A 2/1989 Vandervier et al.
5,038,108 A * 8/1991 Lessi et al. ..... 324/355
5,247,829 A * 9/1993 Ehlig-Economides .... 73/152.37
5,289,875 A 3/1994 Stokley et al.
5,335,542 A * 8/1994 Ramakrishnan et al. . 73/152.08
5,353,875 A * 10/1994 Schultz et al. ..... 166/297
5,549,159 A 8/1996 Shwe et al.
5,731,517 A 3/1998 Ma et al.
6,101,447 A * 8/2000 Poe, Jr. ..... 702/13
6,116,085 A 9/2000 Moffatt et al.
6,131,658 A 10/2000 Minear
6,279,392 B1 8/2001 Shahin, Jr. et al.
6,382,315 B1 * 5/2002 Langseth ..... 166/252.1
6,543,540 B2 * 4/2003 Woie et al. ..... 166/305.1

OTHER PUBLICATIONS

Frick, T.P.; Brand, C.W. and Schlager, B., *Horizontal Well Testing of Isolated Segments*, SPE Journal, Sep. 1996, pp. 261–273.

* cited by examiner

*Primary Examiner*—Frank Tsay
(74) *Attorney, Agent, or Firm*—Trop, Pruner & Hu, P.C.; Jeffrey E. Griffin; Brigitte Jeffery Echols

(57) ABSTRACT

A technique includes measuring a first pressure of well fluid in a first region. The well fluid is produced from a formation into the first region. A second pressure of well fluid is measured in a second region. The second region is isolated from the first region, and the well fluid in the second region is in communication with the formation characteristics (skin, horizontal permeability or vertical permeability, as examples) of the formation is determined from the first and second measured pressures.

40 Claims, 5 Drawing Sheets

WELL TESTING USING MULTIPLE PRESSURE MEASUREMENTS

This application claims the benefit of U.S. Provisional Application No. 60/381,856, filed May 20, 2002.

BACKGROUND

The invention generally relates to well testing using multiple pressure measurements.

After a well is drilled for purposes of hydrocarbon production, the well typically is tested to determine various parameters that characterize the well. For example, the well may be tested to determine the permeability of a particular formation through which the wellbore extends, as well as determining formation damage, often called the "skin."

The term "skin" may be defined as the alteration of permeability due to fluid and particle invasion that occurs during drilling (fluid and mechanical skin respectively). In this manner, fluid and particle invasion during drilling may alter the permeability of the formation near the wellbore (called the "near wellbore formnation") and create very low permeability around the wellbore. Excessive skin may cause an excess pressure drop when the well is produced. Thus, one of the main objectives of well completion is to reduce the skin in order to improve production efficiency.

For many wells, such as horizontal wells, establishing well productivity is difficult because near wellbore formation conditions right after drilling and clean up are complex to assess. Different characteristics of the formation properties along the wellbore and their exposure to mudcake and mud filtrate for different time lengths normally creates variable skin along the wellbore that cannot be evaluated easily by using conventional well testing techniques. Furthermore, variable skin may create non-uniform-flow during production tests that hinders the interpretation of these results. Therefore, challenges to accurately assessing the skin using conventional well testing techniques exist.

Wireline techniques to assess the reservoir parameters typically produce an indication of the reservoir parameters along the near wellbore formation. Furthermore, conventional tests typically produce a single average value that characterizes the skin for the entire wellbore. Thus, a conventional test may not produce an indication of the spatial variation of the skin along a particular wellbore. However, determination of the spatial variation of the skin along the wellbore may be useful for purposes of targeting specific zones of the wellbore for cleanup and near-wellbore stimulation, as some zones may have excessive skin damage and should be isolated for purposes of treatments.

FIG. 1 depicts a typical system 10 for measuring the average skin along a wellbore 11 that extends through a formation 14. In the system 10, a tubular string 13 extends through the wellbore 11 and the annular space between the string 13 and the interior of the wellbore 11 is sealed off by a packer 12 into two isolated segments. For purposes of measuring the average skin, a flow to the surface of the well may be established through the central passageway (for example) of the tubular string 13, and in response to this flow, pressure 22 and flow 23 sensors of the string 13 may measure the respective pressure and rate of the flow. This information may be used to deduce an indication of the average skin and formation parameters associated with the whole wellbore 11 that extends through a formation 14. However, for multi-layer formation and horizontal well with long well hole, the skin and formation parameters can vary significantly. As noted above, the average skin and formation parameters of the formation 11 may not provide the enough resolution needed for proper production development and remedial work. The variations of the skin and formation parameters along well hole in the formation are needed, as average reservoir parameters are not sufficient to plan stimulation treatments or understand spatial variation of formation quality.

Thus, there exists a continuing need for an arrangement and/or technique that addresses one or more of the problems that are stated above and/or possibly addresses problems that are not stated above.

SUMMARY

In an embodiment of the invention, a technique includes measuring the transient pressure in the wellbore at two distinct locations, which we call the first and second regions, with independent pressure sensors as the formation fluid is produced into the first region. The second region may be a passive pressure observation section.

The second region is hydraulically isolated from the first region in the wellbore, and the communication between them takes place through the formation. Formation productivity characteristics (skin, horizontal permeability or vertical permeability, as examples) are determined from the first and second measured pressures.

Advantages and other features of the invention will become apparent from the following description, drawing and claims.

DETAILED DESCRIPTION

Figure 1:
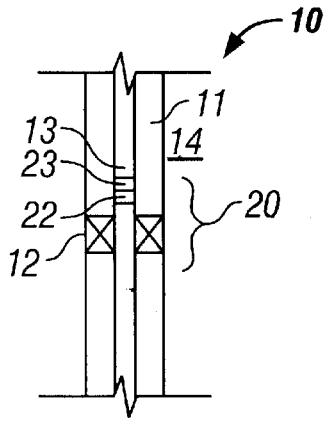
FIG. 1 (Prior Art)
FIG. 1 is a schematic diagram of a well depicting a prior art testing technique.
Figure 2:
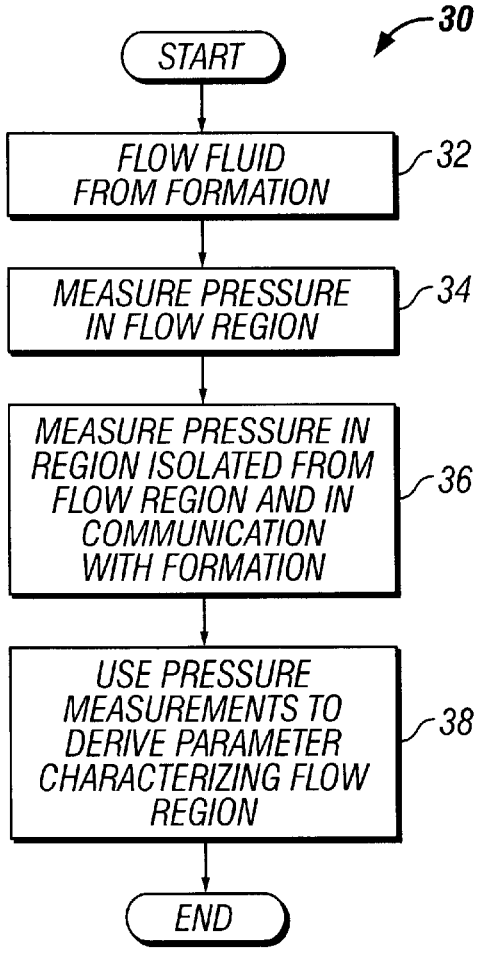
FIG. 2 is a flow diagram depicting a process to determine formation productivity characteristics from pressures measurements as the fluid is produced according to an embodiment of the invention.

Referring to FIG. 2, an embodiment 30 of a process in accordance with the invention uses well fluid pressure measurements at multiple wellbore locations to derive parameters that characterize a formation through which a wellbore extends. As described below, these parameters describe the formation not only near the wellbore but also describe the formation away from wellbore region More particularly, in some embodiments of the invention, the process 30 includes flowing (block 32) fluid from a formation of interest. In this manner, the flow may be induced due to natural well production, assisted lift (fluid or mechanical) or the injection of a fluid. In some embodiments of the invention, the flow may extend to the surface of the well.

The process 30 includes measuring (block 34) a well fluid pressure in a region of the well in which the flow takes place. This measurement constitutes one of the above-described multiple pressure measurements and may be considered a "sink or source point measurement," a flowing or injection pressure depending on the process. The remaining one or more well fluid pressure measurements may be taken outside of the region of flow in another wellbore region that is in communication with the formation of interest. These measurements may be referred to as "observation point measurements." This region in which the observation point measurements are taken is isolated from the region of flow. Thus, block 36 of the process 30 includes measuring pressure in one or more regions that are isolated from the flowing region and in communication with the formation of interest. As examples, the observation point measurement(s) may be taken in an isolated section of the same wellbore that contains the flowing region and/or taken in an isolated section of another wellbore. Regardless of where the observation and sink point pressure measurements are taken, the regions in which these measurements are taken are in communication with the formation of interest.

After the wellbore pressure measurements are obtained, the pressure measurements are then used (block 38) to derive parameters that characterize the formation. In this manner, as described below, parameters, such as horizontal permeability, vertical permeability and skin, may be derived from these measurements. Other and different parameters, such as far field reservoir pressure, may be derived in the various embodiments of the invention.

In the context of this application, the term "fluid" refers to either a liquid, a gas or a combination of a liquid and a gas.

Figure 3:
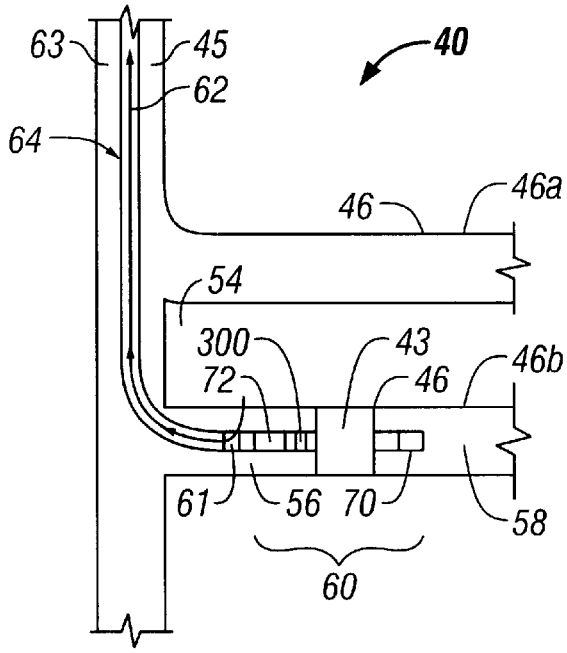
FIGS. 3 and 4 are schematic diagrams of wells according to different embodiments of the invention.

FIG. 3 depicts a system 40 in which the process 30 may be used in accordance with some embodiments of the invention. In this manner, the system 40 includes a main vertical wellbore 45 that serves as the main trunk of a well from which horizontal, or lateral, wellbores 46 (lateral wellbores 46*a* and 46*b* depicted, as examples) may extend. In particular, the lateral wellbores 46*a* and 46*b* extend through a formation 54 of interest. As examples, it may be desirable to use the process 30 to determine the horizontal permeability, vertical permeability and/or skin damage associated with one or more wellbores that extend through the formation 54.

In this manner, to acquire the observation and sink point pressure measurements, a tubular test string 64 may be deployed downhole into the vertical wellbore 45 and maneuvered into the lateral wellbore 46*b*. The tubular test string 64 includes a tool 60 (near its downhole end) that is positioned into the lateral wellbore 46to obtain at least two pressure measurements: one sink point pressure measurement in a region 56 in which a flow (indicated by the arrow 62) to the surface of the well is produced; via a central passageway of the tubular test string 64 and another observation point pressure measurement in a region 58 that is in communication with the formation 54 and is isolated from the flowing region 56.

To perform these measurements, in some embodiments of the invention, the tool 60 includes a pressure sensor 72 that is in communication with the region 56 and a pressure sensor 70 that is in communication with the region 58. The two regions 56 and 58 are hydraulically separated, or isolated, by a packer 43 (of the tool 60), which may be inflatable. The packer 43 seals off the annular space between the exterior of the tubular string 64 and the interior of the wellbore 46*b*. Thus, after the tool 60 is positioned in the lateral wellbore 46 to perform the pressure measurements, the packer 43 may be set. After the packer 43 is set, the central passageway of the tubular string 64 between the regions 56 and 58 may be blocked via a valve (via the closure of a ball valve, for example) to complete the isolation of the two regions 56 and 58. The test string 64 may include one or more valves 61 to establish the flow 62 through the central passageway of the tubular test string 64. For example, these valves may include a circulation valve as well as possibly a ball valve. In this manner, a ball valve, for example, may be closed to prevent the flow 62 for purposes of measuring the formation pressure without flow, and thereafter, the ball valve may be opened to establish the flow 62. Other arrangements and variations are possible.

It is noted that the wellbores described herein may be cased or uncased, depending on the particular embodiment of the invention. However, regardless of whether a particular wellbore is cased or uncased, the process 30 may be performed as described herein.

Continuing the example depicted in FIG. 3, to perform the process in the well, the flow 62 is induced in the region 56. The flow 62 may be produced due to natural well production, assisted lift (fluid or mechanical) or the injection of a fluid. After the flow is established, an electronic circuit 300 (FIG. 7) of the tool 60 communicates data indicative of pressure measurements taken by the pressure sensors 70 and 72. For example, the circuit 300 may store data indicative of the pressure measurements so that the data may be read when the tool 60 is retrieved to the surface of the well. In other embodiments of the invention, the circuit 300 may communicate (in real time, for example) the pressure measurements to circuitry (not shown in FIG. 3) at the surface of the well via one of a variety of different telemetry systems. Other variations are possible and are within the scope of the appended claims.

In some embodiments of the invention, in these pressure measurements, the pressure sensor 72 is used to measure change pressure at the sink point in the region 56 in response to the flow 62. For example, the pressure sensor 72 may obtain an initial pressure measurement in the region 56 before the initiation of the flow 62, and after initiation of the flow 62, the pressure sensor 72 may obtain another pressure measurement in the region 56. Likewise, in the region 58, the pressure sensor 70 is used to measure an observation point pressure differential by obtaining a pressure measurement in the region 58 before the initiation of the flow 62, and after the initiation of the flow 62, the pressure sensor 70 is used to obtain another pressure measurement in the region 58.

The circuit 300 (FIG. 7) may coordinate these differential pressure measurements, in some embodiments of the invention. For example, a command may be communicated downhole to the circuit 300 to record the initial observation and sink point pressure measurement before the flow is induced. A subsequent command may be communicated downhole to the circuit 300 to record the observation and sink point pressure measurements after the flow 62 is induced. Alternatively, the circuit 300 may automatically record these pressure measurements or communicate these pressure measurements to the surface. For example, the circuit 300 may be activated when the packer 43 is set or in response to a command communicated downhole. Thereafter, the circuit 300 may record (or transmit the measured pressures to the surface, alternatively) all pressures measured by the pressure sensors 70 and 72 over some predefined time interval or until receipt of another command communicated downhole. For this arrangement, the pressure differential may be determined by examining the measured pressures. Other variations are possible and are within the scope of the appended claims.

Thus, to summarize, in accordance with some embodiments of the invention, the pressure sensor 72 is used to measure the pressure differential in the region (sink) 56 in response to the initiation of the flow 62, and the pressure sensor 70 is used to measure the observation pressure differential in the region 58 in response to the initiation of the flow 62. It is these pressure differentials that may be used to derive various parameters that characterize the formation 54, as described below.

FIG. 3 depicts measurements of the sink and observation point pressures being conducted in the same lateral wellbore 46*b*. However, in some embodiments of the invention, the observation point measurement may be made in a different wellbore. For example, referring to FIG. 4, in a system 47, two tubular test strings are used: the test string 64 that is described in connection with FIG. 3 and extends into the lateral wellbore 46b; and another tubular test string 66 that has another tool 60 (at its downhole end) that extends into another lateral wellbore 46*a*. For this arrangement, the packer 43 of the string 66 creates another isolation zone 58 on the side of the packer 43 that is isolated from the flow 62. It is noted that this other isolation zone 58 is in communication with the formation 54.

Figure 4:
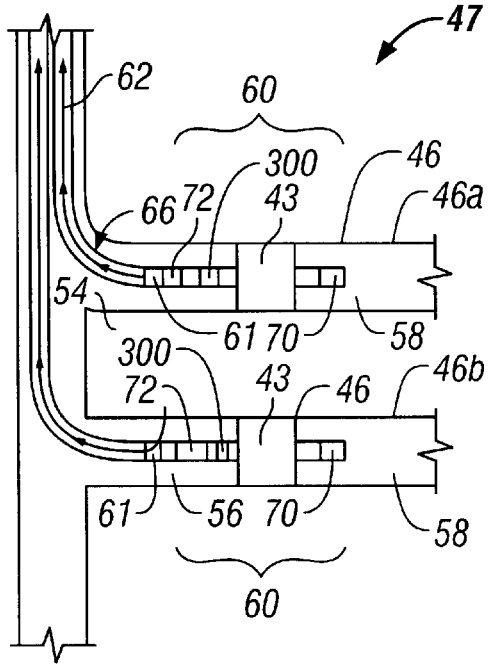

Thus, as can be seen from FIG. 4, observation point pressure measurements may be made in the region 58 in the wellbore 46*a* and possibly may be made in the region 58 in the wellbore 46*b*. For example, observation point pressure measurements may be obtained from the pressure sensors 70 that are located in both wellbores 46*a* and 46*b*; and sink point pressure measurements may be obtained from the sensor 72 located in the wellbore 46*b*. Other variations are possible. The system 47 of FIG. 4 may be expanded to include additional pressure sensors located in other parts of the well so that other observation point or sink point measurements may be made from other parts of the well.

Figure 10:
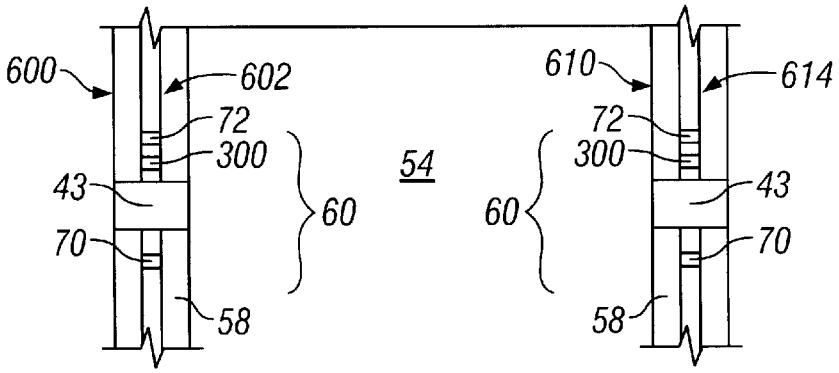
FIG. 10 is a schematic diagram of two wells according to an embodiment of the invention.

The observation and sink point measurements may be taken from points inside different wells. For example, referring to FIG. 10, a string 602 containing the tool 60 may be located inside a vertical well 600, and a string 614 containing the tool 60 may be located inside another vertical well 610. Both wells 600 and 610 are in hydraulic communication with the formation 54. Thus, the tools 60 of both strings 602 and 614 may be used to collect various sink and observation point pressure measurements. For example, either the sensor 70 or 72 of the string 602 may be used to collect observation point pressure measurements. A flow may be initiated in the well 610, and in response to this flow, either the sensor 70 or 72 may be used to collect sink point pressure measurements.

The sink and observation point pressure measurements may be used to derive a parameter that characterizes the formation 54, as described below It is assumed that viscosity $\mu$ and compressibility $c_t$ may be constant, and porosity $\phi$ and the principal permeabilities can vary spatially in the reservoir model that describes the pressure and flow behavior of the system. The pressure distribution in such a system due to production (prescribed fluid flux) at the open interval) may be described by the following relationship:

$$p(t,r)=p_o-\int_{u=0}^{t}du\ q_s(u)g(t-u,r), \qquad \text{Equation (1)}$$

where $P_o$ is the initial pressure, r is the spatial position vector, and t is the time. In Eq. 1, the flow rate $q_s$ and the impulse response g are zero for t<0. The expression given by Eq. 1 is known as Duhamel's theorem. The impulse response g is a solution of the diffusivity equation.

The Laplace transform of Eq. 1 at $r_1=\{x=x_1,y=0,z=0\}$ (i.e., the sink point) may be described as follows:

$$\Delta\bar{p}(s,r_1)=\bar{q}_s(s)\bar{g}(s,r_1), \qquad \text{Equation (2)}$$

and at $r_2=\{x=x_0, y=0,z=0\}$ (i.e., the observation point), the Laplace transform of Eq. 1 be described as follows:

$$\Delta\bar{p}(s,r_2)=\bar{q}_s(s)\bar{g}(s,r_2), \qquad \text{Equation (3)}$$

where $\Delta p=p_o-p(t,r)$, $x_1$ is the coordinate of the sink, and $x_0$ coordinate of the observation point.

Solving Eq. 2 for $\bar{q}_s$ and substituting it in Eq. 3, the Laplace transform of the pressure change at $r_2$ may be rewritten as the following:

$$\Delta\bar{p}(s,r_2)=\Delta\bar{p}(s,r_1)\bar{G}(s,r_1,r_2), \qquad \text{Equation (4)}$$

where $$\bar{G}(s, r_1, r_2) = \frac{\bar{g}(s, r_2)}{\bar{g}(s, r_1)} \qquad \text{Equation (5)}$$

and is called G function. In the time domain, Eq. 4 may be written as $$\Delta p(t,r_2)=\int_{u=0}^{t}du\Delta p(u,r_1)G(t-u), \qquad \text{Equation (6)}$$

where $G(t)=L^{-1}\{\bar{G}(s)=\bar{G}(s,r_1,r_2)=\bar{g}(s,r_2)/\bar{g}(s,r_1)\}$.

It is noted that the flow rates are eliminated from Eq. 6.

The formulation given by Eq. 6, which may be labeled "pressure-pressure convolution," permits parameter estimation to be formulated as the nonlinear least squares problem by minimizing the objective function (the residual sum of squares), J, described below:

$$J(x) = \frac{1}{2}\sum_{i=1}^{Nm} W_i[\Delta p^c(x, t_i, r_2) - \Delta p^m(t_i, r_2)]^2, \qquad \text{Equation (7)}$$

where the model behavior (computed pressure), $\Delta p^c(x,t_i,r_2)$ is given by Eq. 6, x=unknown parameter vector ($k_h$, $k_v$, etc.), $\Delta p^m(t_i,r_2)$=measured pressure at the observation point, $N_m$=number of measured data points, and $W_i$=positive weight factor.

Figure 5:
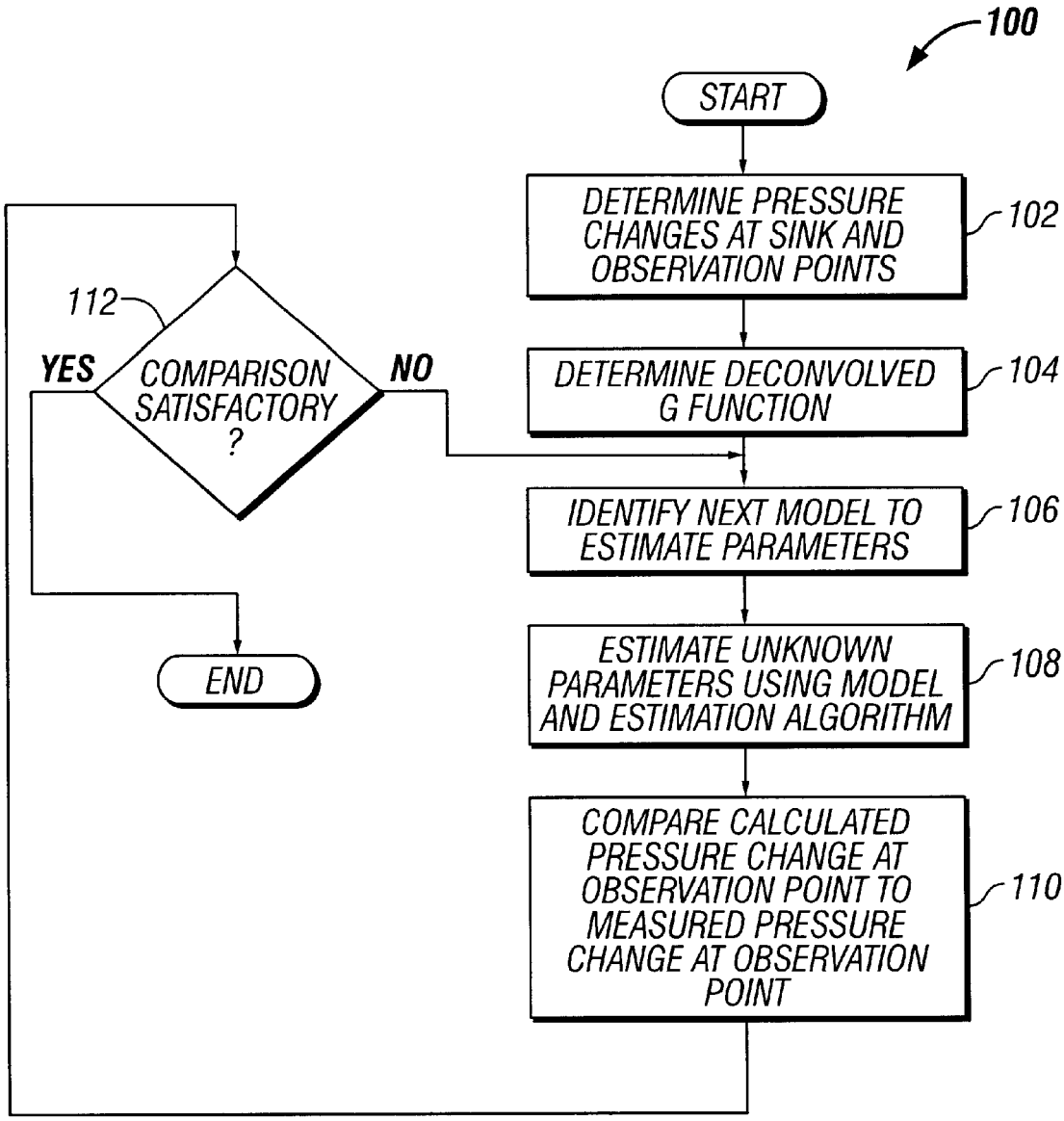
FIG. 5 is a flow diagram depicting a process and interpretation method for determining parameters characterizing the formation and near-wellbore according to an embodiment of the invention.

Referring to FIG. 5, thus, using the above-described pressure-pressure convolution, a process 100 may be used to estimate a particular parameter that characterizes the formation 54. In this process 100, the pressure changes (due to the start of the flow 62) at the sink and observation points are determined (block 102). Subsequently, using these pressure changes, the deconvolved G function is determined (block 104), as described above. Next, the process 100 includes identifying (block 106) a possible model to be used in the estimation of reservoir parameters from the G function. This model identification may be carried out, for example, by searching for a similar signature of the deconvolved G function from a library of available model responses. The geological as well as openhole and/or casedhole log information for the formation may be incorporated with the flow regime analysis for the model identification.

Next in the process 100, using the model obtained from block 106, the unknown reservoir parameters are estimated (block 108) using an estimation algorithm, such as, for example, a nonlinear inversion or least squares algorithm, such as the least squares algorithm that is depicted in Eq. 7. This estimation algorithm may involve an iterative process during which some of the model parameters may be dropped from the unknown parameters if the measurements are not sensitive to them. Consequently, these parameters are fixed, or constant during the estimation.

After the unknown parameter(s) are estimated, a comparison (block 110) is made between the measured and the calculated pressure changes at the observation point . This comparison may be done, for example, graphically. If a determination (diamond 112) is made that the comparison is satisfactory, then the estimation and interpretation are complete. Otherwise, the process 100 returns to block 106 to identify another model to estimate the unknown parameter (s).

Figure 9:
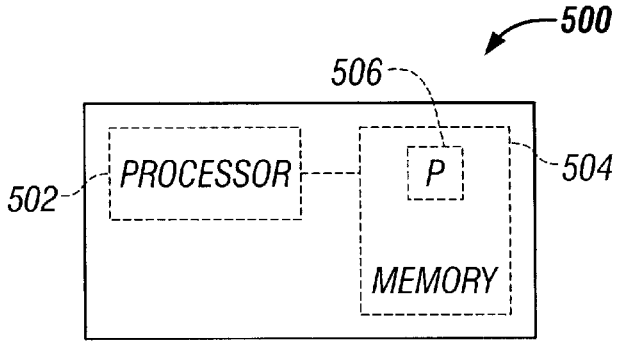
FIG. 9 is a schematic diagram of a computer according to an embodiment of the invention.

Referring to FIG. 9, in some embodiments of the invention, the process 100 may be partially or completely performed by a computer 500. In this manner, the computer 500 may include a processor 502 (one or more microprocessors, for example) that executes a program 506 (stored in a memory 504 of the computer 500) that causes the processor 502 to perform some or all of the process 100 according to the particular embodiment of the invention.

Figure 6:
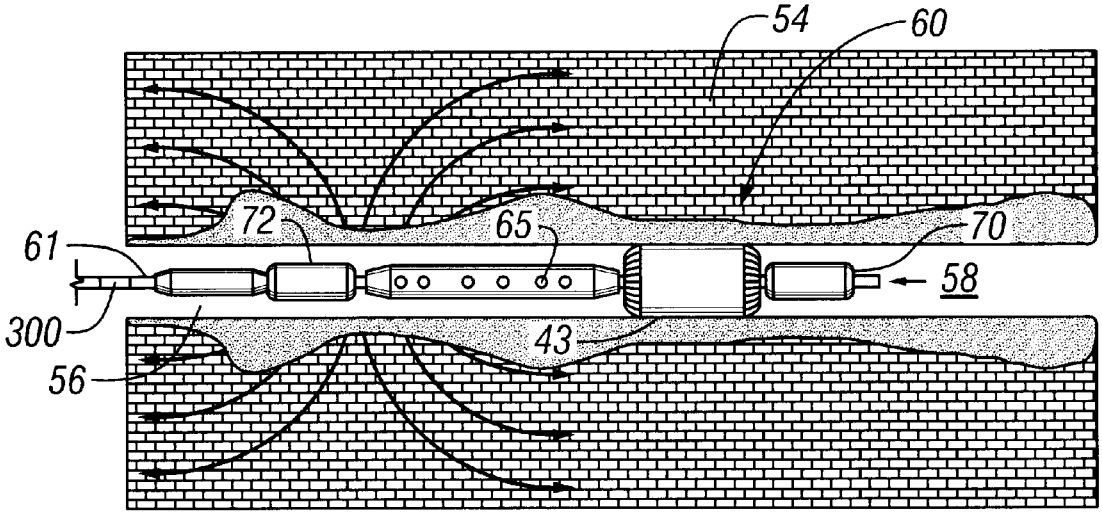
FIGS. 6 and 7 are schematic diagrams of tools according to different embodiments of the invention.

FIG. 6 depicts a more detailed schematic diagram of the tool 60, according to some embodiments of the invention. As shown, the tool 60 may include a perforating unit 65 that may be used to form perforations through the sandface that can be barefoot or cased 54 for purposes of initiating a flow from the formation 54. The tool 60 may also include a deep resistivity or induction sonde or resistivity or induction array 67 as well as the pressure sensor 72. The resistivity sonde 67, pressure sensor 72 and perforating unit 65 are located on the side of the packer 43 that forms the flow region 56. Located on the opposite side of the packer 62 is the pressure sensor 70 that is located in the isolated region 58. The fluid entry ports into the string and valves is not shown in FIG. 6.

For horizontal or vertical wells, the tubular string to which the tool 60 is connected may be a coiled tubing system that provides push and pull motion of the tool 60 through the wellbore. The resistivity sonde 61 may be designed so that it provides radial resistivity profiles in the near-wellbore region with a minimum radius of investigation at least more than a few feet.

Figure 7:
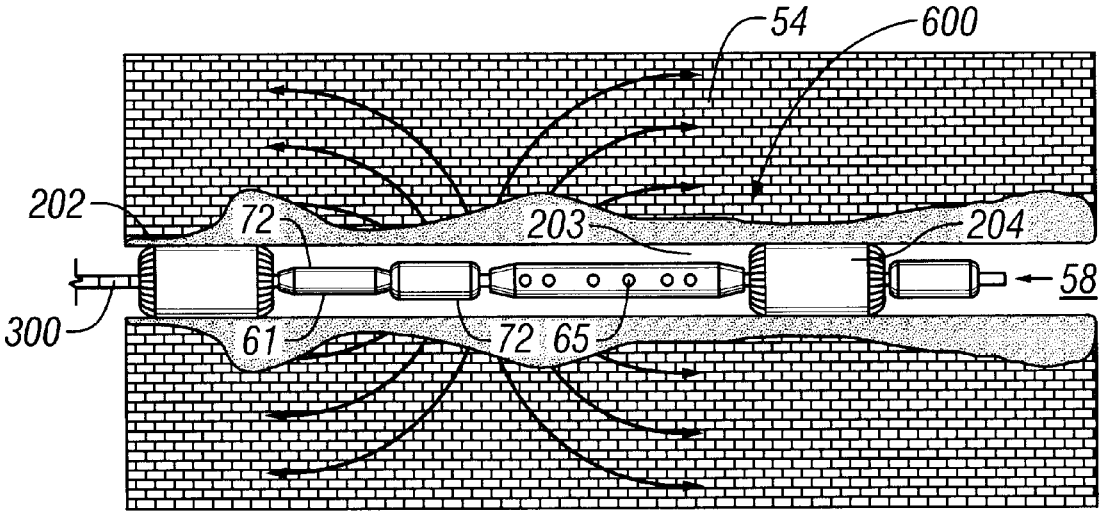

For purposes of obtaining an indication of the spatial variation of a particular parameter along a particular wellbore, a tool 200 that is depicted in FIG. 7 may be used in place of the tool 60. As an example, the tool 200 may be used to obtain an indication of the spatial variation of skin along a particular wellbore.

The tool 200 is similar in design to the tool 60, except for the following differences. In particular, in place of the packer 43, the tool 200 includes two packers 202 and 204 that create a zone of interest 203 that is situated between the two packers 202 and 204 and forms an interval in which a flow is present. Thus, sink point pressure measurements may be taken in the interval 203 via the pressure sensor 72. Because the tool 200 confines the flow region to a specific region of a particular wellbore, parameters for the zone of interest 203 may be calculated. The tool 200 may also be used in vertical wellbores.

Thus, the tool 200 may be moved from the toe of a particular lateral wellbore (for example) to the heel of the wellbore, and at each position, parameters of the formation in the zone of interest 203 may be calculated. Therefore, using the tool, an indication of the spatial variation of parameters along a particular wellbore may be determined. The resolution of this spatial variation may be dependent on the length of the zone of interest and the distance the tool 200 is moved between measurements. Overlapping measurements may be averaged to possibly improve the accuracy of the measurements.

The creation of the zone 203 by the packers 202 and 204 may permit additional operations to be performed while the tool 200 is being used to obtain the above-described pressure measurements. For example, one such operation may involve possibly injecting acid into the zone 203 if the zone 203 has a high degree of skin. In this manner, a technique may be performed in which skin is removed from the wellbore wall and near-wellbore formation in the zone 203 while pressure measurements are being taken in real time to asses the skin and control the acidization process accordingly.

Figure 8:
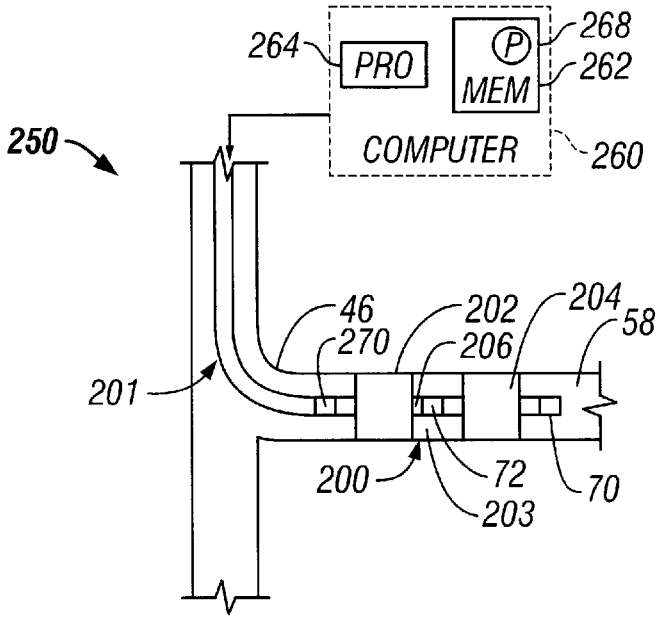
FIG. 8 is a schematic diagram of a well according to another embodiment of the invention.

More particularly, referring to FIG. 8, in some embodiments of the invention, a system 250 may be used to control the operation. In this manner, the system 250 includes a tubular string 201 that includes the tool 200 at its downhole end, and the tool 200, as shown, is positioned in a lateral wellbore 46 of the well. A circuit 270 (which may of similar design to the circuit 300) is in communication with a computer 260 that is located at the surface of the well via one of a variety of different telemetry techniques. In this manner, the computer 260 includes a processor 264 (a microprocessor, for example) that executes a program 268 that is stored in a system memory 262. Due to the execution of the program 268, the processor 264 receives an ongoing real time stream of data that is provided by the circuit 270 and is indicative of the pressures sensed by the sensors 70 and 72. In this manner, by executing the program 268, the processor 264 may determine the skin of the formation around zone 203. Thus, the processor 264 may control the acidization process (via a pump and other equipment (not shown) at the surface of the well) until the desired level of skin has been reached in the zone 203. Alternatively, if the skin factor does not change during the acidization, as per the interpretation of the monitored data, an early termination of the acidization process may be possible. Circulation valves (not shown) may be used to pump acid into the formation. Excess acid may be removed via valves of the string, such as circulation valves, for example. Other arrangements for controlling a downhole tool in response to real time measurements provided by the multiple pressure measurement technique that is described herein are possible.

Other embodiments are within the scope of the following claims. For example, although arrangements with single packers have been discussed above, in some embodiments of the invention, multiple packers may be used to prevent movement of the packers to protect integrity of the measurements.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A method comprising:

measuring wellbore pressure in a first region while the fluid is flowing from the formation into the first region;

measuring wellbore pressure in a second region that is hydraulically isolated from the first region and the wellbore fluid in the second region being in communication with the formation; and determining characteristics of the formation from the first and second region measured pressures.

2. The method of claim 1, wherein the first and second regions are in the same well.

3. The method of claim 1, wherein the first region is part of a first well and the second region is part of a second well different from the first well, and the first and second wells are in hydraulic communication through the information.

4. The method of claim 1, wherein determining comprises:

determining parameters that characterize the formation.

5. The method of claim 1, wherein the parameters comprise one of a horizontal permeability, vertical permeability and skin that are spatially varying.

6. The method of claim 1, wherein determining comprises:

selecting a reservoir model to compute the first and second region pressures.

7. The method of claim 1, wherein determining comprises:

determining the first and second region pressure changes.

8. The method of claim 1, further comprising:

setting a packer to isolate the first and second regions; and setting a packer to minimize the volume of the wellbore in the second region.

9. The method of claim 1, wherein the first and second regions are located in the same wellbore.

10. The method of claim 1, wherein the first and second regions are located in different wellbores.

11. The method of claim 1, further comprising:

moving the first and second regions along the wellbore; and determining formation characteristics in response to the moving.

12. A method comprising:

measuring a first pressure of well fluid in a first region;

performing an operation in the first region, the operation perturbing a well formation;

measuring a second pressure of well fluid in a second region, the second region being isolated from the first region and the well fluid in the second region being in communication with the formation; and regulating the operation based on the measuring of the first and second pressures.

13. The method of claim 12, wherein the first and second regions are in the same well.

14. The method of claim 12, wherein the first region is part of a first well and the second region is part of a second well different from the first well, and the first and second wells are in hydraulic communication through the formation.

15. The method of claim 12, wherein the operation comprises:

injecting an acid into the first region for formation stimulation.

16. The method of claim 15, wherein the perturbing comprises:

allowing the well fluid to flow from the first region, steadily or with a pulse encoding.

17. The method of claim 12, further comprising:

determining a skin in the first region.

18. The method of claim 12, further comprising:

determining characteristics of the formation in response to the first and second measurements.

19. The method of claim 18, wherein the regulating comprises:

halting operation in response to the characteristic reaching a predetermined threshold.

20. The method of claim 12, further comprising:

communicating indications of the first and second pressures to the surface of the well.

21. A tool usable in a subterranean well, comprising:

a first pressure sensor located in a first region of the well;

a second pressure sensor located in a second region of the well;

a packer to isolate the first and second regions; and a circuit to record first measurements by the first pressure sensor made in response to a well fluid in the first region flowing from a formation of the well and record second measurements by the second pressure sensor in response to the well fluid flow from the first region.

22. The tool of claim 21, further comprising:

an additional packer to form the first region between the first packer and said additional packer.

23. The tool of claim 21, further comprising:

a perforating unit to perforate the formation in the first region.

24. A tool usable in a subterranean well, comprising:

a first pressure sensor located in a first region of the well;

a second pressure sensor located in a second region of the well;

a packer to isolate the first and second regions; and a circuit to communicate first measurements by the first pressure sensor made in response to a well fluid in the first region flowing from a formation of the well to the surface of the well, and communicate second measurements by the second pressure sensor in response to the well fluid flow from the first region to the surface of the well.

25. The tool of claim 24, further comprising:

an additional packer to form the first region between the first packer and said additional packer.

26. The tool of claim 24, further comprising:

a perforating unit to perforate the formation in the first region.

27. A system usable with a subterranean well, comprising:

a string to be at least partially disposed downhole in the subterranean well;

a first pressure sensor connected to the string and located in a first region of the well;

a second pressure sensor connected to the string and located in a second region of the well;

a packer connected to the string to isolate the first and second regions; and a circuit connected to the string to record first measurements by the first pressure sensor made in response to a well fluid in the first region flowing from a formation of the well and record second measurements by the second pressure sensor in response to the well fluid flow from the first region.

28. The system of claim 27, further comprising:

an additional packer to form the first region between the first packer and said additional packer.

29. The system of claim 27, further comprising:

a perforating unit to perforate the formation in the first region.

30. A system usable with a subterranean well, comprising:

a string to be at least partially disposed downhole in the subterranean well;

a first pressure sensor connected to the string and located in a first region of the well;

a second pressure sensor connected to the string and located in a second region of the well;

a packer connected to the string to isolate the first and second regions; and a circuit connected to the string to communicate first measurements by the first pressure sensor made in response to a well fluid in the first region flowing from a formation of the well to the surface of the well, and communicate second measurements by the second pressure sensor in response to the well fluid flow from the first region to the surface of the well.

31. The system of claim 30, further comprising:

an additional packer to form the first region between the first packer and said additional packer.

32. The system of claim 30, further comprising:

a perforating unit to perforate the formation in the first region.

33. An article comprising a computer readable storage medium storing instructions to cause a processor to:

receive at least one measurement of a first pressure of well fluid in a first region of the well, the well fluid in the first region flowing from a formation of the well;

receive at least one measurement of a second pressure of well fluid in a second region of the well, the second region being isolated from the first region and the well fluid in the second region being in communication with the formation; and determine characteristics of the formation from the first and second measured pressures.

34. The article of claim 33, further comprising instructions to cause the processor to determine a parameter that characterizes the formation.

35. The article of claim 34, wherein the parameter comprises one of a horizontal permeability, vertical permeability and skin.

36. The article of claim 33, further comprising instructions to cause the processor to select a model to estimate the first and second pressures.

37. The article of claim 33, further comprising instructions to cause the processor to make the determination in response to changes in the first pressure and changes in the second pressure.

38. A tool usable in a subterranean well, comprising:

a first pressure sensor located in a first region of the well and in hydraulic communication with a formation, the first pressure sensor being adapted to measure a pressure in the first region;

a second pressure sensor located in a second region of the well and in hydraulic communication with the formation, the second pressure sensor being adapted to measure a pressure in the second region; and a packer to isolate the first and second regions.

39. The tool of claim 38, further comprising:

an additional packer to form the first region between the first packer and said additional packer.

40. The tool of claim 38, further comprising:

a perforating unit to perforate the formation in the first region.

* * * * *